US005906004A

United States Patent [19]

Lebby et al.

[11] Patent Number: 5,906,004

[45] Date of Patent: May 25, 1999

[54] TEXTILE FABRIC WITH INTEGRATED ELECTRICALLY CONDUCTIVE FIBERS AND CLOTHING FABRICATED THEREOF

[75] Inventors: Michael S. Lebby, Apache Junction; Karen E. Jachimowicz, Laveen, both of Ariz.

[73] Assignee: Motorola, Inc., Schaumburg, Ill.

[21] Appl. No.: 09/069,621

[22] Filed: Apr. 29, 1998

[51] Int. Cl.[6] ..... D03D 15/00

[52] U.S. Cl. ..... 2/1; 139/425 R; 174/5 R; 174/5 SG; 442/210; 2/905

[58] Field of Search ..... 2/1, 69, 94, 102, 2/243.1, 905; 174/5.5 B, 5 R, 5 SG; 361/212, 221–223; 442/208, 209, 210, 212; 139/425 R

[56] References Cited

U.S. PATENT DOCUMENTS

| | | | |
|---|---|---|---|
| 3,288,175 | 11/1966 | Valco . | |
| 3,778,331 | 12/1973 | Scharf | 161/67 |
| 3,987,613 | 10/1976 | Woods et al. . | |
| 4,196,355 | 4/1980 | Maine . | |
| 4,254,951 | 3/1981 | De Laney | 273/1 F |
| 4,590,623 | 5/1986 | Kitchman . | |
| 4,735,847 | 4/1988 | Fujiwara et al. | 428/209 |
| 4,753,088 | 6/1988 | Harrison et al. | 66/202 |
| 4,929,803 | 5/1990 | Yoshida et al. | 139/425 R |
| 5,103,504 | 4/1992 | Dordevic . | |
| 5,538,781 | 7/1996 | Rao et al. | 139/425 R |
| 5,802,607 | 9/1998 | Triplette | 2/69 |

FOREIGN PATENT DOCUMENTS 0383059 12/1992 European Pat. Off. .

OTHER PUBLICATIONS

Engineered Materials Handbook, Desk Edition, ASM International, pp. 436–437, and 1219, Nov. 1995.

*Primary Examiner*—John J. Calvert
*Assistant Examiner*—Tejash D Patel
*Attorney, Agent, or Firm*—Eugene A. Parsons; William E. Koch

[57] ABSTRACT

A textile fabric including a plurality of electrically conductive fibers characterized as providing sufficient current to induce either a wired or wireless coupling between the textile fabric and a portable electronic device. The textile fabric is intended for fabrication into a functional article of clothing or other item made of the woven textile fabric, so as to increase functionality of the article of clothing or item made thereof. The plurality of electrically conductive fibers are characterized as creating an interconnect to a portable electronic device, including integrated components, electronics, or the like, or serving as an antenna for signals received and transmitted by the portable electronic device.

18 Claims, 2 Drawing Sheets

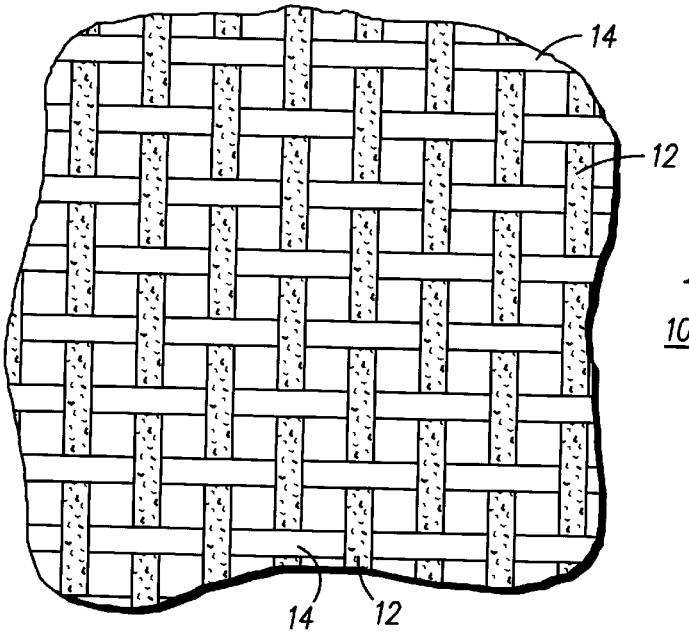
FIG. 1
10
FIG. 2
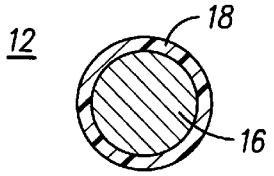
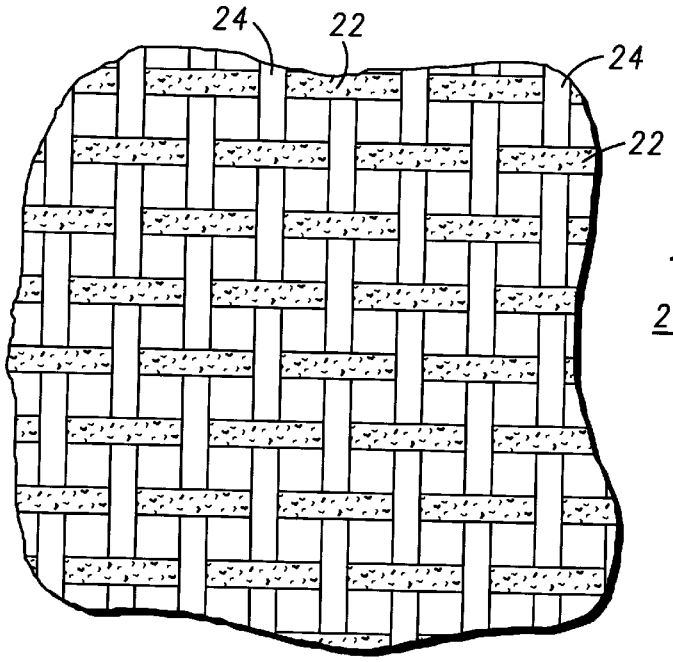
FIG. 3
20
FIG. 4
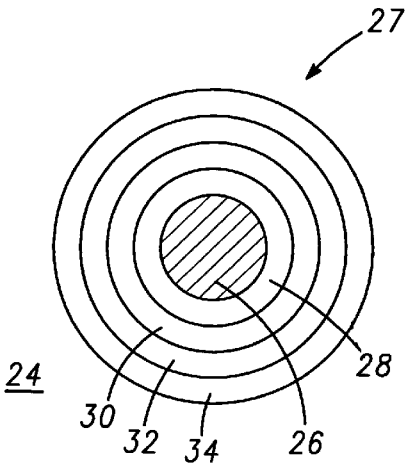

TEXTILE FABRIC WITH INTEGRATED ELECTRICALLY CONDUCTIVE FIBERS AND CLOTHING FABRICATED THEREOF

FIELD OF THE INVENTION

This invention relates, in general, to textile fabric and, more particularly, to textile fabric that includes electrically conductive fibers for increased functionality of clothing fabricated thereof.

BACKGROUND OF THE INVENTION

Clothes have always been to some extent a form of art and design, combining both color and functionality. Color is typically given to fabric, and to the resulting clothes, by dying the textile fibers. The color that the clothes appears to the eye, depends on which wavelengths the fabric absorbs and which wavelengths it reflects. Functionality of clothes is often limited to the design and the inclusion of various materials, and elements, such as pockets and loops, or the like. For the most part, today's clothing typically includes pockets, beltloops, buttons and buttonholes, snaps, etc., and other design elements that increase its functionality.

Generally speaking, the average person will wear a plurality of clothing articles on a daily basis to which will be attached or placed in a pocket of the clothing, a portable electronic device, such as a cellular telephone, a pager, a PDA, a micro-recorder, a small electronic address or data file, a clock/alarm, or some other similar portable electronic device. The problem is that it is often difficult and unwieldy to carry various communication transceivers, such as cellular phones, pagers and other devices.

By using the principles of functionality and color in the fabrication of textile fabrics, and more particularly clothing, increased potential can be found in everyday garments. More particularly, by including functional fibers into textile fabrics, such as through the inclusion of metallic threads, and holographic optical fibers, clothes can be fabricated which are both user friendly in allowing the wearer to better communicate with others, sense surroundings and control their personal environment while minimizing the size of any additional portable electronic equipment that the user typically carries.

In many instances these portable devices are operated utilizing a wireless transmission link. This wireless link, or coupling, is dependent upon the user positioning of the portable electronic device and often times is unreliable as to the ability to receive and/or transmit due to a weak link. In addition, another hardship incurred by the user of these types of devices is the carrying of numerous communication devices while participating in recreational activities, such as biking, running, fishing, or the like.

Thus, it would be highly desirable to provide for a textile fabric that when fabricated into a wearable garment or other functional design, provides for increased functionality of the woven material and thus the garment made thereof.

Accordingly, a textile fabric and clothing fabricated thereof, that incorporates electrically conductive fibers, thus emanating an electromagnetic field for inductive coupling and alternatively providing for a wired coupling would be highly advantageous.

It is a purpose of the present invention to provide for a new and improved textile fabric, including a plurality of electrically conductive fibers, that provides for increased functionality when fabricated into an article of clothing.

It is a further purpose of the present invention to provide for a textile fabric that allows for a wired, a wireless, or an inductive interconnect to small portable electronic devices, e.g., a pager, a cellular telephone, a datebook, a clock/alarm, an informational wire service receiver, a micro-recording device, a SMART CARD reader, or the like.

It is still another purpose of the present invention to provide a new and improved textile fabric and article of clothing fabricated thereof that provides for the reduction in size of integrated portable communication devices by integrating a portion of the electronics or component parts into the textile fabric.

It is another purpose of the present invention to provide for a new and improved textile fabric and article of clothing made thereof wherein the clothing creates a local area network (LAN), thus serving as an antenna for improved reception and transmission capabilities of a portable electronic device coupled thereto.

It is yet another purpose of the present invention to provide for a new and improved textile fabric and article of clothing including a plurality of electrically conductive fibers, and additionally including a plurality of holographic optical fibers that provide for the receipt, transmission and ultimate display of communicative information.

SUMMARY OF THE INVENTION

Briefly stated, provided is a textile fabric that includes a plurality of electrically conductive fibers and a plurality of additional fibers. The fabric is characterized as either emanating an electromagnetic field for a wireless interface, such as through inductive coupling, or providing for a wired interface to a portable electronic device. The textile fabric is intended for fabrication into a functional article of clothing or other item made of the woven textile fabric, so as to increase functionality of the article of clothing or item made thereof. The plurality of electrically conductive fibers are characterized as creating an interconnect to a portable electronic device, wherein the fabric includes integrated components, electronics, or the like, or serving as an antenna for signals received and transmitted by a portable electronic device.

BRIEF DESCRIPTION OF THE DRAWINGS

The novel features believed characteristic of the invention are set forth in the claims. The invention itself, however, as well as other features and advantages thereof will be best understood by reference to detailed descriptions which follow, when read in conjunction with the accompanying drawings, wherein:

FIG. 1 is a plan view of a portion of a first embodiment of an inventive textile fabric illustrating a plurality of individual conductive fibers and a plurality of non-conductive fibers according to the present invention;

FIG. 2 is a cross-sectional diagram of a conductive textile fiber according to the present invention;

FIG. 3 is a plan view of a portion of a second embodiment of an inventive textile fabric according to the present invention illustrating a plurality of individual conductive fibers and a plurality of holographic optical fibers;

FIG. 4 is a cross-sectional diagram of a holographic optical fiber according to the present invention;

DETAILED DESCRIPTION OF THE DRAWINGS

Figure 5:
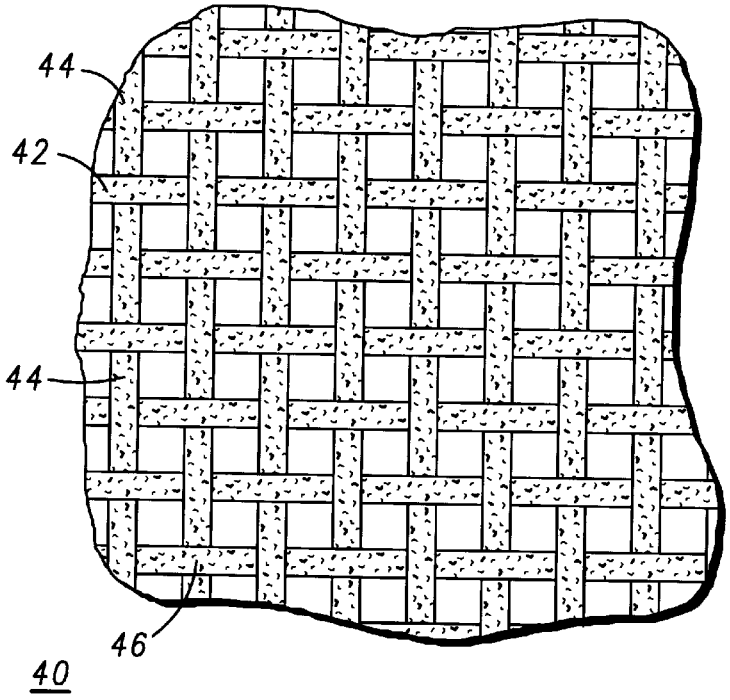
FIG. 5 is a plan view of a portion of a third embodiment of an inventive textile fabric according to the present invention illustrating a plurality of individual conductive fibers.

The present invention discloses an inventive textile fabric with integrated electrically conductive fibers that is characterized as emanating an electromagnetic field for inductive coupling or capable of a wired interface utilizing interconnects. Clothing fabricated from this inventive textile fabric would allow the wearer to achieve greater functionality from the clothing, such as allowing the user to better communicate with others, sense his surrounding environment and control his own personal environment. Optionally included in this type of textile fabric would be displays, including holographic optical fibers. Dependent upon the layout of the electrically conductive fibers, circuits, antennas, or other similar electronic components can be integrated or formed therein the textile fabric. One premise for the textile fabric and clothing made thereof would be for the receipt and transmission of communicative signals through electromagnetic inductive coupling, and alternatively through a wired or wireless coupling. More particularly, in the preferred embodiment inductive coupling or wired coupling with a portable electronic device such as a cellular phone, pager, or the like would be easily achieved.

In one embodiment, the electronics and/or device components of the portable electronic device would be established with the textile fabric, and more particularly an article of clothing made of the inventive textile fabric, utilizing a wired connection, a wireless connection, or through inductive coupling. Alternatively, the textile fabric would serve as an antenna, or the like for the receipt and transmission of communicative signals. In the instance where inductive coupling is sought, the inventive fabric would allow for the establishment of an electric charge or a magnetic field between the fabric and a portable electronic device based on the proximity of an electrified source, a magnet, or a magnetic field.

Referring now to FIG. 1, illustrated in simplified plan view is a greatly enlarged portion of a first embodiment of an inventive textile fabric according to the present invention. The illustrated portion of textile fabric is generally designated 10. In this particular embodiment, textile fabric 10 is composed of a plurality of electrically conductive fibers, or metallic threads, 12 and a plurality of non-electrically conductive fibers, or non-metallic threads, 14 woven orthogonal so as to define a simple grid system. Textile fabric 10 is generally illustrated as including a space between conductive fibers 12 and non-electrically conductive fibers 14 so as to allow individual addressing of the plurality of fibers 12 and 14. It should be further understood that in this particular embodiment, conductive fibers 12 do not define cross-over points. Generally, speaking this type of grid system would allow for the electrical interface, more specifically the wired interconnect, with a portable electronic device and/or electronic or component parts of the portable electronic device. More particularly, electrically conductive fibers 12 would allow for the integration into textile fabric 10, electronic components, such as semiconductor chips, a power source, a microphone, or other similar components typically found in a portable device that are individually addressable. This inclusion of electronic components or other similar components would allow for the reduction in size of a coupled electronic device.

Referring now to FIG. 2, illustrated in simplified cross-sectional view is a single electrically conductive fiber 12 according to the present invention. In this particular example, electrically conductive fiber 12 is composed of a central metallic core 16 and an insulative overcoating layer 18. Central metallic core 16 is described as composed of an electrically conductive material, which may include a metallic material, a semi-metallic material, a semi-insulative material, a semi-conductive material, a transparent conductive material and any other fiber material that provides sufficient current to induce wired or wireless coupling between textile fabric 10 and a portable electronic device.

Insulative overcoating 18 is disclosed as composed of an insulative material, such as KELVAR, as commonly used in the fiber optic industry, a plastic material, such as any organic polymer based material, for example PMMA or polyimide, or some other similar insulative material. Insulative overcoating 18 serves to insulate central metallic core 16 from defining electrical connections where they are not desired. In particular, insulative overcoating 18 prevents electrical cross-talk, more specifically, signal crossings from one conductive fiber 12 to another. It is additionally disclosed, that conductive fibers 12 are alternatively formed of a solid metallic fiber, or a fiber having a non-metallic core and a metallic overcoating.

Referring now to FIG. 3 illustrated in simplified plan view is a portion of a second embodiment of a textile fabric according to the present invention, referenced 20. Textile fabric 20 in this particular embodiment is composed of a plurality of electrically conductive fibers 22 and a plurality of holographic optical fibers 24. Similar to textile fabric 10 of FIG. 1, fibers 22 and fibers 24 are woven in orthogonal directions so as to define a simple grid system typically found in woven textile fabrics. Electrically conductive fibers 22 are disclosed as being generally similar to electrically conductive fibers 12 of FIG. 1, and accordingly will not be discussed further. Holographic optical fibers 24 are disclosed as textile fibers that selectively absorb or reflect different wavelengths of light using layers of transparent optical media with differing indices of refraction. When these layers of differing indices of refraction are positioned correctly with respect to incident light, colors, patterns and images are formed by the resulting interference patterns. The multi-layer interference coatings are designed to selectively reflect a particular band of wavelengths, while transmitting others. When utilizing a plurality of these holographic optical fibers to form a portion of textile fabric 20, the resulting interference patterns of the plurality of holographic optical fibers 24 form varying colors, patterns, and images, and thus can be utilized to form displays in textile fabric 20, more particularly in clothing fabricated from textile fabric 20, thus eliminating the need for a display on an associated portable electronic device.

Referring now to FIG. 4, illustrated in further detail is holographic optical fiber 24 according to the present invention. In this particular embodiment, holographic optical fiber 24 is described as a passive holographic optical fiber. As illustrated, fiber 24 includes a light absorbing central core 26, surrounding by a plurality of layers of optical media material having varying indices of refraction, designated multi-layer overcoating 27. More particularly, fiber 24 includes light absorbing central core 26, such as a black thread, and a first layer of optical media 28 having an index of refraction of $n_1$, a second layer of optical media 30 having an index of refraction of $n_2$, a third layer of optical media 32 having an index of refraction of $n_1$ and a fourth layer of optical media 34 having an index of refraction of $n_2$. In general, when light absorbing central core 26 is composed of a black thread, the black thread consists of a plurality of threads, twisted so as to form a single thread. In keeping with this theory of a twisted black core thread, layers 28, 30, 32 and 34 can also be formed so as to twist around light absorbing central core 26, generally forming a single twisted textile fiber. It should be understood that central core 26 in an alternate embodiment includes either a light reflecting material or a light transmitting material. In this particular embodiment, a white light, including red, green and blue wavelength light, is incident on fiber 24. As illustrated, due to the varying indices of refraction of layers 28, 30, 32, and 34 a portion of the incident light will be transmitted through layers 28, 30, 32 and 34 and will be ultimately absorbed by absorbing core 26 and a portion of the light will be reflected by the multi-layer stack of optical media 27 on fiber 24. This reflection of a specific wavelength of light will be seen as giving color to fiber 24. This fiber is described as being passive, in that there is no change in the index of refraction of the layers 28, 30, 32, and 34 thus fiber 24 always reflects the same wavelength of light and is thus always seen as one particular color. It should be understood that there can be greater or fewer layers than those shown in the preferred embodiment, more indices of refraction and differences in thicknesses depending on the particular wavelength of light to be reflected. In addition, an active fiber can be fabricated through the addition of a conductive layer that provides for an external voltage to be applied to a specific multi-layer overcoating. An example of a material which would change its index of refraction under the influence of a voltage is a liquid crystal material. Thus under the influence of a voltage, the index of refraction of at least one of the optical layers would be changed, thus changing the reflecting properties of fiber 24. Additional information on holographic optical fibers can be found in U.S. patent application entitled "HOLOGRAPHIC OPTICAL FIBER", filed simultaneous herewith, bearing attorney docket number CR 98-044, assigned to the assignee and incorporated herein by this reference.

Referring now to FIG. 5, illustrated in simplified plan view is a portion of a third embodiment of the textile fabric according to the present invention, generally referenced as 40. Textile fabric 40 in this particular embodiment is composed of a plurality of electrically conductive fibers 42 and 44. Fibers 42 and 44 are woven orthogonal to each other so as to create a grid system composed solely of electrically conductive fibers. As illustrated, fibers 42 and 44 create crossover points 46, thereby placing fibers 42 and 44 in electrical contact. This weaving of fabric 40 so as to create a mesh-like pattern is typically utilized when fabric 40 is fabricated into an article of clothing that includes antenna properties, more particularly an article of clothing that will serve to improve the transmission and/or receipt of radiated signals. Spacing of fibers 42 and 44 is dependent upon the exact usage and frequency required for the antenna as it aids a particular type of electronic device. For instance, when a garment fabricated from fabric 40 is utilized as an antenna for a cellular communication device, the frequency, thus spacing of fibers 42 and 44, would be different than when a garment fabricated from fabric 40 is utilized as an antenna for a paging device. In general, by creating a mesh-like system from fabric 40 a local area network (LAN) that improves the receipt and transmission of radiated signals is created about a wearer of a garment fabricated from fabric 40.

As previously disclosed, electrically conductive fibers 42 and 44 can include, a metallic material, a semi-metallic material, a semi-insulative material, a semi-conductive material, a transparent conductive material or any other fiber material that provides sufficient current to create an electromagnetic field. More particularly, metallic materials are disclosed as including steel, iron, nickel, cobalt, copper, gold, chromium, molybdenum, tungsten, tin, zinc, manganese, thallium, aluminum, magnesium, and the like and mixtures thereof. Semi-insulative materials include gallium nitride (GaN), aluminum nitride (AlN), and the like. Semi-metallic and semi-conductive materials include binary materials such as gallium arsenide (GaAs), aluminum phosphide (AlP), aluminum arsenide (AlAs), gallium phosphide (GaP), indium phosphide (InP), indium arsenide (InAs), gallium antimonide (GaSb), indium antimonide (InSb), zinc selenide (ZnSe), and the like. Ternary materials include gallium arsenide phosphide (GaAsP), aluminum gallium arsenide (AlGaAs), gallium indium antimonide (GaInSb), aluminum gallium phosphide (AlGaP), gallium indium arsenide (GaInAs), indium arsenide antimonide (InAsSb), and the like. Transparent conductive materials include transparent metals such as indium oxide (InO), tin oxide (SnO), indium-tin-oxide (ITO), or the like.

Figure 6:
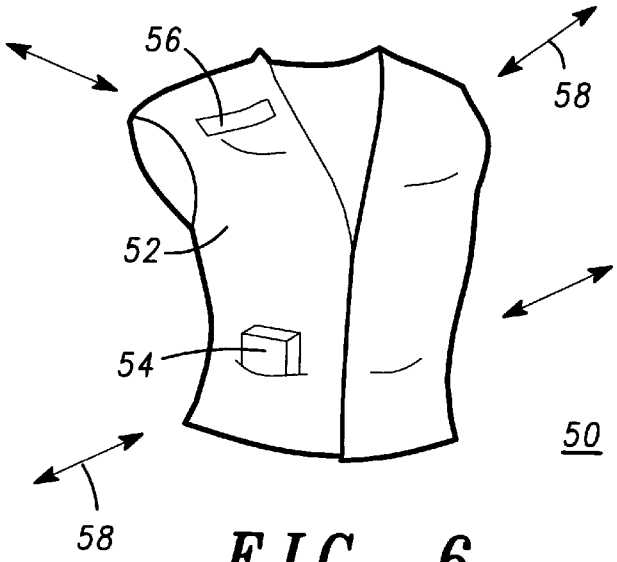
FIG. 6 is a simplified front view of an article of clothing made from the inventive textile fabric according to the present invention.

Referring now to FIG. 6, illustrated in simplified front view is an article of clothing 50 fabricated from the inventive textile fabric of the present invention. In this particular embodiment, clothing 50 includes fabric generally similar to textile fabric 10 of FIG. 1 and fabric 40 of FIG. 5. As illustrated, clothing 50 is designed in the style of a vest and is intended to be worn by one seeking to improve communicative transmissions. In particular, this style of clothing would benefit those participating in athletic activities, such as biking, running, skiing, fishing, or the like, where hands free capabilities as well as the reduction in the size of the portable communication device would be beneficial.

As illustrated in this particular embodiment, there is provided a pocket 51 integrated with clothing 50 in which stored is a portable electronic device 54, such as a cellular telephone. Cellular telephone 54 in this particular embodiment is in electrical communication with a plurality of electrically conductive fibers (not shown), that allow for improved receipt and transmission of signals and allow for a reduction in size of cellular telephone 54. It should be understood, that portable electronic device 54 is in electrical communication with the plurality of electrically conductive fibers through at least one of a wired or wireless interface, such as through a plug-in type connector or through inductive coupling. As illustrated, there is provided as an integrated part of clothing 50, a microphone 56 which is in electrical communication with cellular telephone 54 through the plurality of electrically conductive fibers. This placement of the microphone component of cellular telephone 54 provides for the wearer of clothing 50 to communication through device 54 without the need to actually hold device 54. It should be understood that while described is the integration of a microphone component with the inventive textile fabric, additional electronic components are intended by this disclosure and would lead to a further reduction in size of cellular telephone 54. In addition, clothing 50 can include antenna capabilities as previously discussed with regard to FIG. 5, to further improve the receipt and transmission of signals 58 with cellular telephone 54. It should be understood that while described is an article of clothing in the style of a vest, this is only intended to be representative of any number of styles of clothing that can be fabricated from the inventive textile fabric of the present invention.

Thus, described is a textile fabric including a plurality of electrically conductive textile fibers, that dependent upon specific fabrication can be fabricated into an article of clothing thus providing an interconnect for electronic components, or alternatively providing increased signal receipt and transmission by creating a local area network (LAN) about a wearer of the clothing. The textile fabric and clothing fabricated thereof as described is intended for use by a consumer seeking to reduce the size of portable electronic devices which are normally carried or improving their signal receipt and transmission capabilities, thereby integrating an external electronic device with clothing that is being worn.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A textile fabric including a plurality of electrically conductive fibers and a plurality of non-electrically conductive fibers, including a plurality of holographic optical fibers, wherein the electrically conductive fibers are characterized as providing sufficient current to induce at least one of a wired and wireless coupling between the textile fabric and a portable electronic device.

2. A textile fabric according to claim 1 wherein the plurality of electrically conductive fibers include a metallic material.

3. A textile fabric according to claim 2 wherein the metallic material includes at least one of copper, gold, steel, iron, nickel, cobalt, chromium, molybdenum, tungsten, tin, zinc, manganese, thallium, aluminum, and magnesium.

4. A textile fabric according to claim 1 wherein the plurality of electrically conductive fibers include a semi-metallic material.

5. A textile fabric according to claim 1 wherein the plurality of electrically conductive fibers includes a semi-insulative material.

6. A textile fabric according to claim 1 wherein the plurality of electrically conductive fibers include a semi-conductive material.

7. A textile fabric according to claim 6 wherein the semi-conductive material includes at least one of a silicon material and a gallium arsenide (GaAs) material.

8. A textile fabric according to claim 1 wherein the plurality of electrically conductive fibers include a transparent conductive material.

9. A textile fabric according to claim 8 wherein the transparent conductive material includes an indium-tin-oxide (ITO) material.

10. A textile fabric according to claim 1 wherein the plurality of electrically conductive fibers are woven in orthogonal directions thereby defining a plurality of cross-over points.

11. A textile fabric according to claim 1 wherein the plurality of electrically conductive fibers and the plurality of non-electrically conductive fibers are woven in orthogonal directions thereby providing for individual addressing of each of the plurality of electrically conductive fibers.

12. An article of functional clothing fabricated of a textile fabric including a plurality of electrically conductive fibers and a plurality of non-electrically conductive fibers including a plurality of holographic optical fibers, the plurality of electrically conductive fibers characterized as providing sufficient current to induce at least one of a wired and wireless coupling between the article of functional clothing and a portable electronic device.

13. An article of functional clothing according to claim 12 wherein the portable electronic device includes a portable communication device.

14. An article of functional clothing according to claim 12 wherein the textile fabric and the portable electronic device are in electrical interface utilizing a wireless connection.

15. An article of functional clothing according to claim 12 wherein the textile fabric and the portable electronic device are in electrical interface utilizing a wired connection.

16. An article of functional clothing according to claim 12 wherein the textile fabric including a plurality of electrically conductive fibers is characterized as creating a local area network (LAN) about a wearer of the functional clothing, thereby providing an antenna for the portable electronic device.

17. An article of functional clothing comprising:

a textile fabric including a plurality of conductive fibers and a plurality of non-electrically conductive holographic optical fibers; and an electrical interface between the textile fabric and at least one portable electronic device.

18. An article of functional clothing as claimed in claim 17 wherein the electrical interface between the textile fabric and the plurality of electrically conductive fibers includes at least one of a wired and a wireless interface.

* * * * *